United States Patent [19]

DeAnda et al.

[11] 4,108,437

[45] Aug. 22, 1978

[54] TOY VEHICLE STARTING AND LAUNCHING SET

[75] Inventors: Nicholas DeAnda, Redondo Beach; Robert F. Dyer, Rancho Palos Verdes; Roger A. Newbold, Garden Grove, all of Calif.

[73] Assignee: Mattel, Inc., Hawthorne, Calif.

[21] Appl. No.: 759,633

[22] Filed: Jan. 17, 1977

[51] Int. Cl.[2] ..... A63B 9/14

[52] U.S. Cl. ..... 273/86 D; 46/1 K; 46/202

[58] Field of Search ..... 46/1 K, 202, 206; 273/86 D

[56] References Cited

U.S. PATENT DOCUMENTS

| | | | |
|---|---|---|---|
| 3,496,674 | 2/1970 | Cooper | 46/257 |
| 3,545,757 | 12/1970 | Tepper | 273/86 D |
| 3,648,454 | 3/1972 | Morrison | 58/14 A |
| 3,658,333 | 4/1972 | Carcel | 273/86 C |
| 3,707,802 | 1/1973 | Tucker et al. | 46/1 K |
| 3,908,303 | 9/1975 | McKay et al. | 46/1 K |

*Primary Examiner*—Louis G. Mancene
*Assistant Examiner*—Robert F. Cutting
*Attorney, Agent, or Firm*—John G. Mesaros; Max E. Shirk; Stephen L. King

[57] ABSTRACT

A launching and starting apparatus for use with toy racing cars or the like, the starting apparatus having a pathway for passage thereon of a toy vehicle, the pathway including a resettable trigger engageable by a toy vehicle with a flag selectively raised by the trigger. A gravity operated timer is provided and is operable from a raised to a lower position, actuation of the trigger prior to the timer being at its lower position resulting in raising of the flag. An audible signalling device is actuated in response to the timer reaching its lower position to initiate a "start" signal to the user of the apparatus.

8 Claims, 12 Drawing Figures

38
40
46
42
42b
42a
44
42d
42c
36
26
28
30
32

58
60
62
24
40
42
44
70
40
42
20
44
22

54
52
40
50
46
42

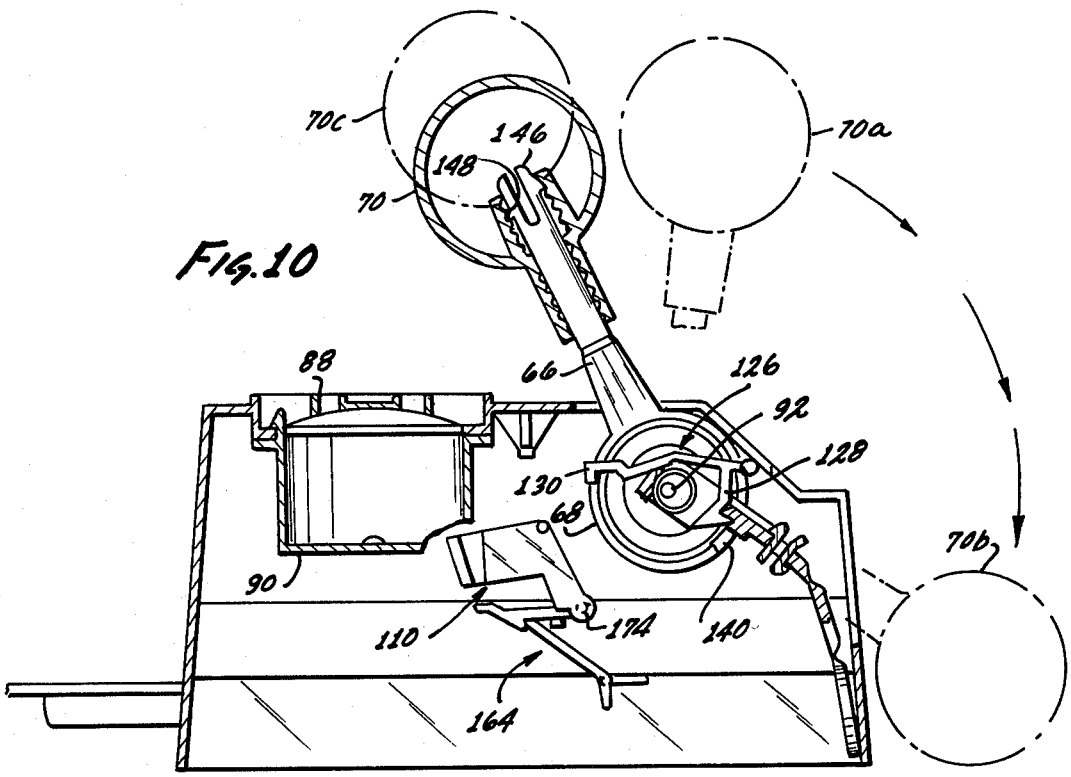
FIG. 10
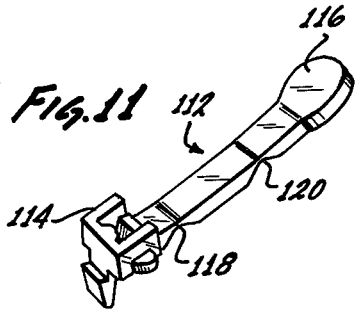
FIG. 11
FIG. 12
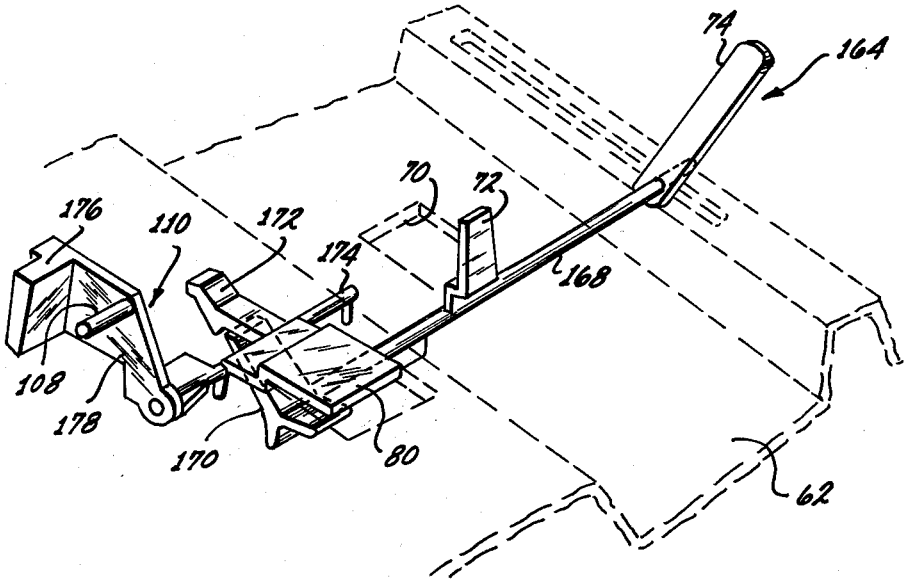

TOY VEHICLE STARTING AND LAUNCHING SET

BACKGROUND OF THE INVENTION

The background of the invention will be discussed in two parts:

1. Field of the Invention

The present invention relates to a toy vehicle launching and starting system and, more particularly, to a starting system having a delayed starting indicator which is gravity operated to a lower position to indicate the start of the race. The apparatus is simply constructed and inexpensive to manufacture and includes provisions for indicating a premature start of one of the racing vehicles.

2. Description of the Prior Art

Small toy vehicles have become exceedingly popular among small children. These vehicles are usually sold in sets which include track sections connectible together to allow various track layouts to be constructed. To enhance the play value of such sets, the sets generally include accessories such as starters and the like. In a typical set utilizing two vehicles and two tracks, generally in parallel to simulate a two lane racetrack, each track is provided with its own starter and accessory can be provided such as a finish gate at the terminal end of the two tracks, the finish gate having a mechanically actuated flag mechanism operable to a position indicative of the vehicle passing through the gate first.

Such vehicles, which may be of the die-cast metal variety, may also be employed with accelerators or toy vehicle launchers which are usually powered by resilient means such as an elastic band to propel the vehicle under control of the operator, the vehicles being otherwise free wheeling and may be of the type for example as shown in U.S. Pat. No. 3,510,981 to H. W. LaBranche, et al.

A delayed starting indicator of the prior art type is shown and described in U.S. Pat. No. 3,707,802 to J. I. Tucker, Jr. The utilization of such accessories enhances the amusement of the child when using the apparatus to simulate an automobile race of the drag race type. In this type of race, vehicles are raced over a measured relatively short course with the winner being that car which first crosses the finish line after accelerating from a stopped position.

It is accordingly an object of the invention to provide a new and improved toy vehicle launching and starting system.

It is another object of the invention to provide a new and improved delayed start signalling and indicating apparatus having audible signalling means.

It is a further object of the invention to provide a new and improved delayed start signalling and indicating apparatus wherein the amount of delay is adjustable.

It is still a further object of the invention to provide a new and improved starting apparatus which is compact in size yet simple and effective in construction.

SUMMARY OF THE INVENTION

The foregoing and other objects of the invention are accomplished by providing a toy vehicle launching and starting apparatus having a launcher with different settings to provide different launching forces to propel the vehicle. A delayed start indicating apparatus is provided with two pathways for passage thereon of two vehicles to simulate a drag race, each pathway having a trigger adapted to be engaged by a vehicle as the vehicle passes thereon, the trigger being selectively operatively connected to a flag which may be raised to indicate a premature start of a vehicle traversing the pathway. Timer means are provided, utilizing a knob and handle assembly, the handle being operable from a raised position under the force of gravity to a lower position. An audible signalling means is provided to be set by movement of the handle to the upper position and to be triggered by the handle reaching the lower position, the signalling means including a spring-biased pivotally mounted frame having a clapper at the pivoted end striking a speaker member upon its sudden release.

Other objects, features and advantages of the invention will become apparent upon a reading of the specification when taken in conjunction with the drawings.

BRIEF DESCRIPTION OF THE DRAWINGS

FIG. 10 is a cross-sectional view similar to the view of FIG. 6, showing in dotted lines, the positions of the knob and handle assembly;

FIG. 11 is a perspective view of the clapper utilized in the clapper assembly of FIG. 9; and FIG. 12 is a perspective view of the trigger lever and flag lever in operative relationship within the pathway shown in phantom illustration.

DESCRIPTION OF THE PREFERRED EMBODIMENT

Figures 1, 2, 3:
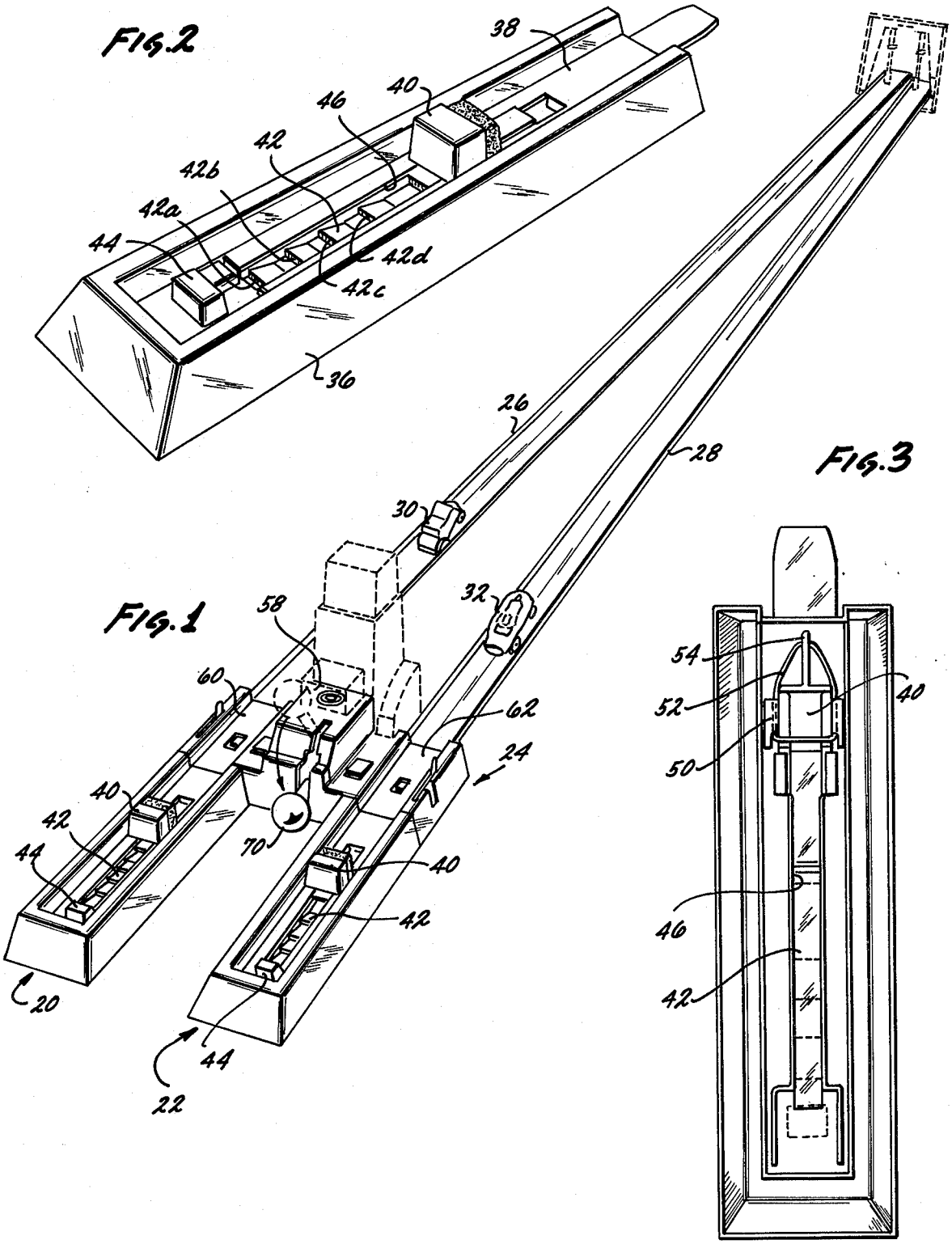
FIG. 1 is a perspective view of a track assembly showing the toy vehicle launching and starting apparatus.
FIG. 2 is a perspective view of the toy vehicle launcher according to the invention.
FIG. 3 is a bottom view of the toy vehicle launcher of FIG. 2.

Referring now to the drawings and particularly to FIG. 1 there is show a track system for miniature toy racing vehicles, the system including first and second toy vehicle launchers 20 and 22, a delayed start indicating apparatus 24 and two sets of track 26 and 28 respectively for passage thereon of toy vehicles 30 and 32 respectively. Each of the toy vehicle launchers 20 and 22 is identical and include a molded base 36 and a preformed vehicle pathway 38. A pusher arm 40 is slidable on the pathway and is activated by a latch mechanism 42 which is formed integral with the base 36 (see also FIGS. 2–4), the latch mechanism 42 being essentially a blade type member integral with the base 36 at the rearend thereof and having a sawtooth cross-sectional configuration to provide a plurality of detent positions **42*a*–42*d*, each of the detent positions being capable of restraining the pusher arm 40. The latching mechanism 42 is provided at the fixed end thereof with a depressible raised button 44 while the other end of latch mechanism 42 is unrestrained to permit the downward depression of button 44 to appropriately release the pusher arm 40** to thereby launch the vehicle.

Figure 4:
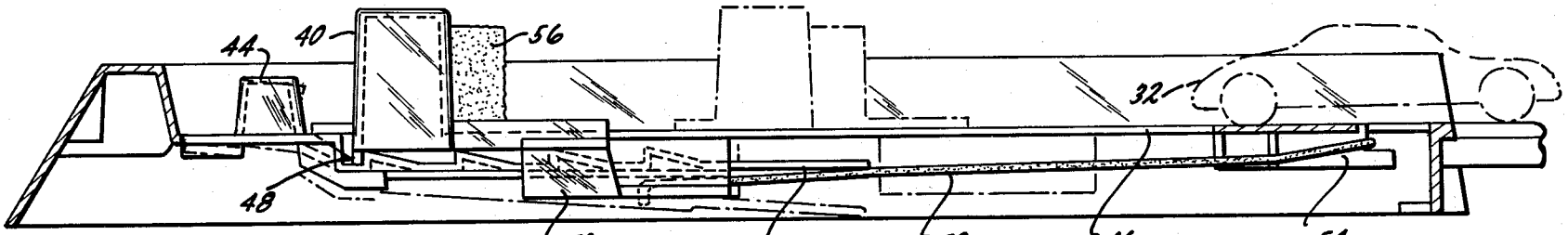
FIG. 4 is a cross-sectional side elevation of the toy vehicle launcher of FIG. 2.

As better illustrated in FIG. 4 the pusher arm 40 is slidably retained within a slot 46 within the pathway 38. Downwardly depending from the underside of pusher arm 40 is an integral bar portion 48 adapted to coact with each of the detents 42*a*–42*d* depending on the operator's desires. The front-end of the pusher arm 40 is provided with a pair of downwardly extending legs 50 which straddle the latch mechanism 42, the legs 50 being configured to retain an elastic band 52 which has the other end thereof secured beneath the pathway 38 on a retaining member 54 formed integral therewith.

The dimensions of the pathway 38 and the slot 46 along with the latching mechanism 42 are so configured to permit a toy vehicle to be positioned on the pathway 38 with the wheels thereof on either side of the slot 46. In operation, the operator slides the pusher arm 40 against the force of its elastic band 52 to a selected position when the bar 48 of pusher arm 40 detents in one of the respective detent positions. At this point, the vehicle 32 is placed on the pathway 38 with the rear bumper portion thereof abutting against a resilient cushion member 56 suitably affixed to the upright surface of pusher arm 40. The operator then depresses the button 44 to resiliently depress the latching mechanism which effectively rotates about its fixed point at the rear end thereof until the upper edge of the respective detent is lowered a distance sufficient to permit the downwardly depending bar 48 to disengage and thereby move forward (to the right, or dotted line position, as viewed in FIG. 4) to thereby launch the vehicle 32. By the utilization of a plurality of detent positions 42*a*–42*d* when the race participants are utilizing the track layout illustrated in FIG. 1 various lengths of track 26 and 28 can be employed with a corresponding adjustment in speed by the participants utilizing the same detent on each of the launchers 20 and 22 depending on the length of track used. As a result, if a long track is used the pusher arms 40 can be retracted to the rear-most position indicated in solid lines in FIG. 4. Correspondingly, if a shorter track length is utilized one of the other detented positions can be employed.

Figure 5:
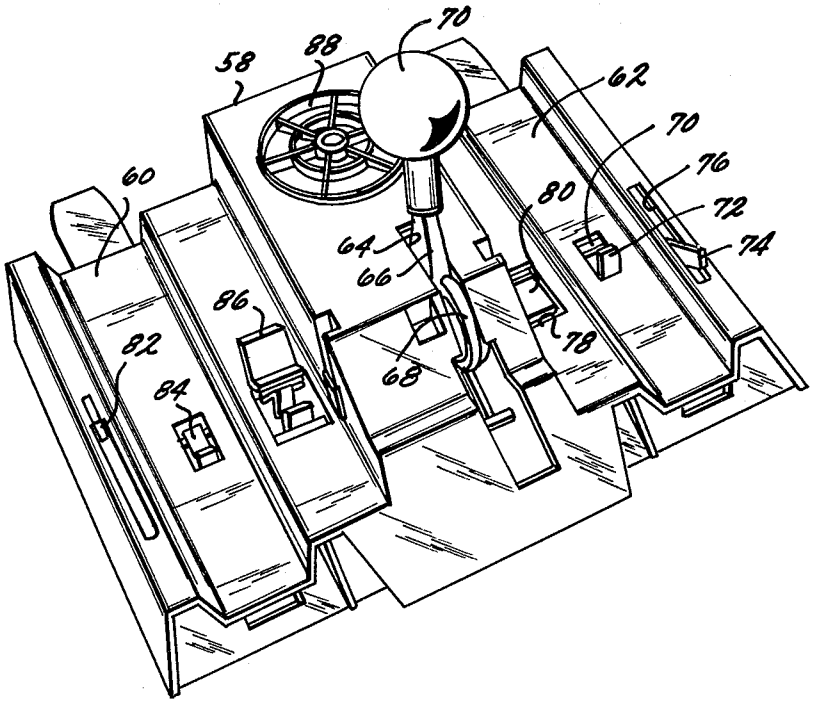
FIG. 5 is a perspective view of the delayed start indicating apparatus of FIG. 1.

Referring now to FIGS. 1 and 5 the delayed start indicating apparatus will be described and includes a housing 58 having formed therein left and right pathways 60 and 62 respectively, each of which when suitably connected to its respective launcher 20 and 22 along with the track 26 and 28 is adapted to permit passage of toy vehicle thereon. The end of the pathway 60 and 62 closest to the toy vehicle launcher 20 and 22 respectively is the entrance end with the other end correspondingly being the exit end for passage of the vehicle from the pathway to its respective track portion. Centrally disposed within housing 58 is an upwardly extending portion which is provided with a slot 64 through which extends a handle 66 having a circular end portion 68 pivotally mounted within housing 58. The upper end of handle 66 is provided with a knob 70, the knob and handle assembly being pivotable from an upper position as shown in FIG. 5 to a lower position shown in FIG. 1 and as will be hereinafter discussed is adapted to be pivoted under the force of gravity when the knob 70 is moved slightly rearwardly until the center of gravity thereof is over the pivot point of handle 66.

Since each of the pathways 60 and 62 is identically equipped from a functional standpoint, although mechanically the parts will essentially be mirror images, the mechanism associated with the right pathway 62 only will be discussed. The pathway 62 is provided along its longitudinal center line with a centrally disposed rectangular aperture 70 which is configured to permit a trigger 72 to fit therein, when actuated by a vehicle contacting the same, into the aperture 70 with the upper surface of trigger 72 relatively flush with the pathway 62. The trigger 72 is integral with a reset switch arm 74 which is pivotable along with trigger 72 in the direction of travel of the vehicle, the switch arm 74 being accessible through an elongated slot 76 formed in a curb portion of housing 58. On the curb portion of housing 58 opposite the switch arm 74 a second much larger rectangular aperture 78 is formed in housing 58, the aperture 78 being configured to receive a flag 80 with the surface flush with the adjacent surface of the housing 58 with the flag 80 in its lowered position.

For illustrative purposes the right pathway 62 has the trigger 72 thereof illustrated in an upright position, that is substantially perpendicular to the plane of pathway 62, with the switch arm 74 adjacent the rear of slot 76, this being the reset position to position the trigger 72 in the pathway for subsequent interception by the vehicle traversing the pathway 62. With the flag 80 having the surface thereof flush with the adjacent surrounding surface of the housing 58, that is with the flag 80 down, the position of trigger 72 and flag 80 along with the handle 66 and knob 70 being in the position shown would correspond to the initial condition of both pathways prior to the start of a race.

The other pathway 60 has the switch arm 82 thereof shown in its forward position with its respective trigger 84 flush with the surface of pathway 60, this condition existing after passage of a vehicle over pathway 60 engaging the trigger 84 thereby pivoting it along with its switch arm 82 in the forward direction to the position illustrated. The flag 86 associated with the pathway 60 is in its raised position, this position only occurring after initial setup of the delayed start indicating apparatus 24 if a vehicle should traverse pathway 60 prematurely before the knob 70 reaches its lower position.

Positioned forwardly of slot 64 in the upwardly extending portion of housing 58 is grillwork 88 which has a speaker member 90 therebelow to provide an audible signal when knob 70 reaches its lower position as will hereinafter be described.

Figure 8:
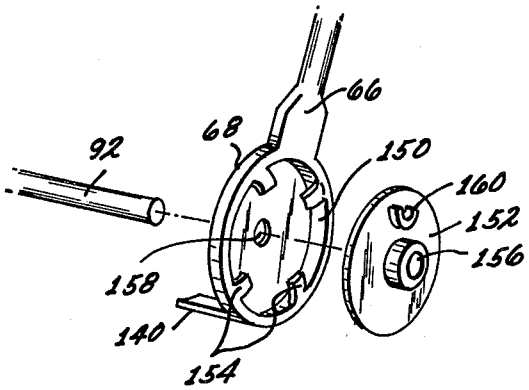
FIG. 8 is an exploded perspective view, partially broken away, of the clutch mechanism of the timer of the apparatus of FIG. 5.
Figure 6:
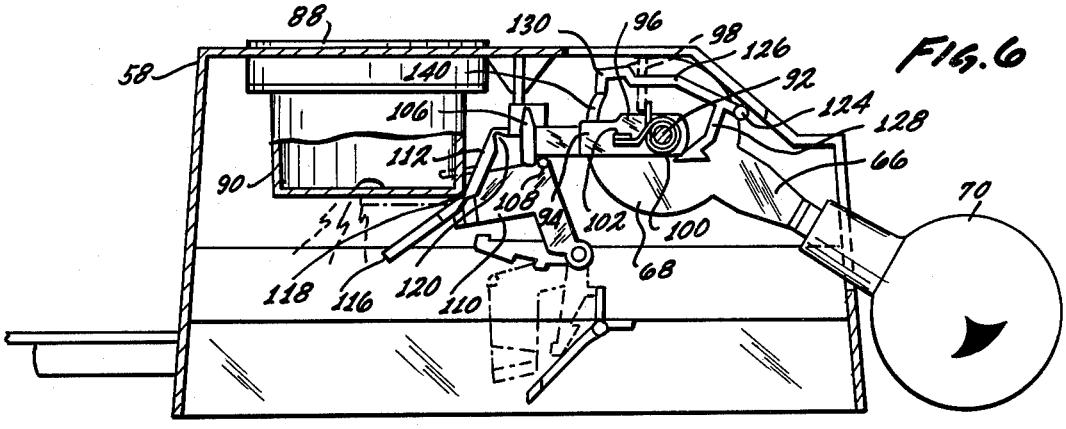
FIG. 6 is a cross-sectional view, partially broken away, taken along the longitudinal line through the center of the apparatus of FIG. 5.
Figure 7:
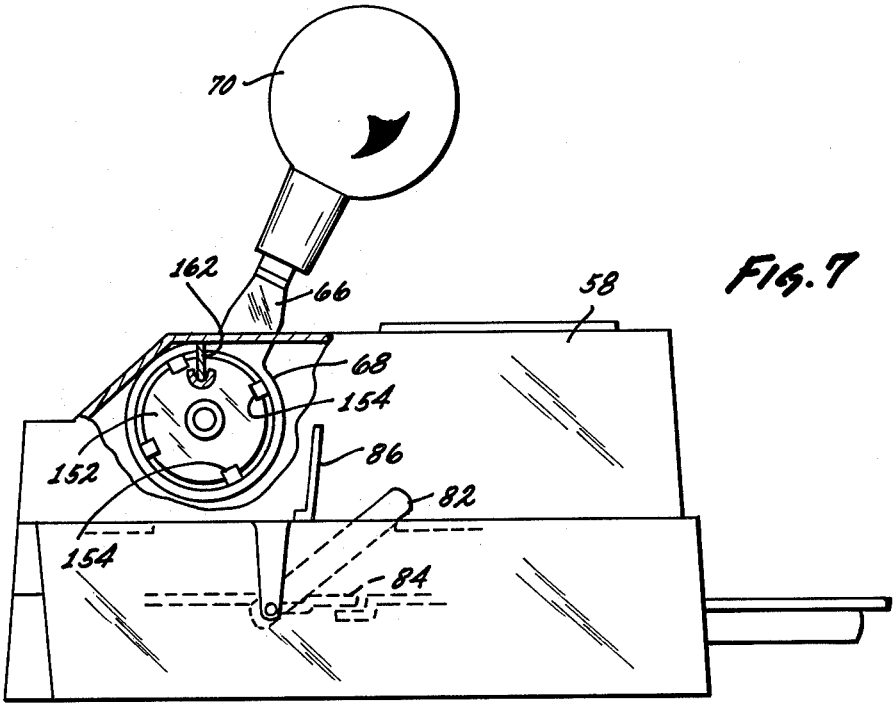
FIG. 7 is a side elevation of the apparatus of FIG. 5 partially broken away.

As shown in FIGS. 6–8 the enlarged circular portion 68 on the handle 66 is pivotally secured within the housing for rotation about a shaft 92 suitably affixed to housing 58. Also rotatable about the same shaft 92 is a clapper mechanism which includes a clapper framework 94 which is provided at one end thereof with a pair of arms 96 (only one of which is shown) having apertures extending therethrough for mounting on shaft 92. Encircling shaft 92 is a torsion spring having one end thereof secured from rotation by means of a downwardly extending projection 98 (shown in dotted lines in FIG. 6) which is integral with the inner surface of housing 58, the other end of torsion spring 100 abutting against an integrally formed portion 102 of clapper framework 94. The other end of clapper framework 94 has outwardly extending inhibitor members 106 adapted to coact with a projection 108 integral with flag lever 110 under certain prescribed conditions. Extending outwardly from the free end of clapper framework 94 is a clapper 112 which, as better illustrated in FIG. 11, is a generally resilient plastic member having an enlarged end 114 configured for retention by clapper framework 94, the other end 116 of clapper 112 being an enlarged generally disc-shaped portion. Intermediate the opposing ends of clapper 112, the material is provided with thinner cross-sectional portions 118 and 120, which as can be seen in FIG. 6, are positioned along the length of clapper 112 to permit the bending thereof during operation with the clapper end 116 striking the speaker member 90 to emit an audible tone.

Figure 9:
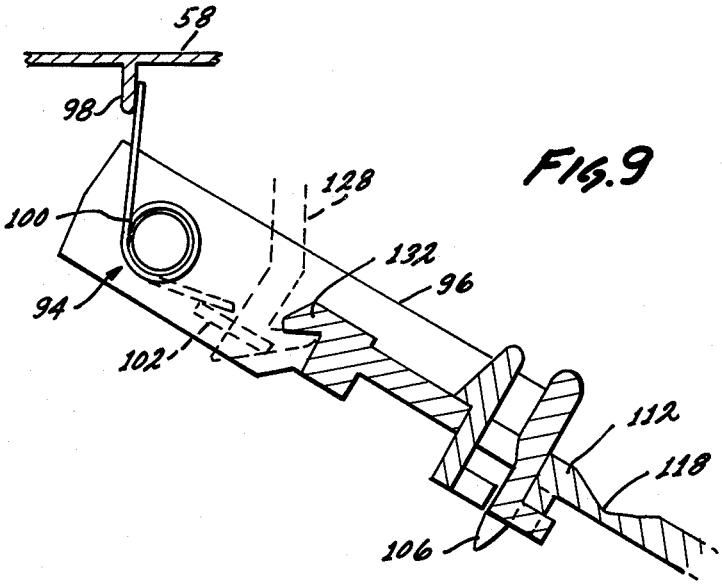
FIG. 9 is a partial sectional view of the clapper mechanism used in the apparatus of FIG. 5.

Pivotally mounted within housing 58 at pivot point 124 is a generally inverted U-shaped trip arm 126, the arms of trip arm 126 being respectively a latch arm 128 and a release arm 130, the latch arm 128 being adapted to coact with a suitable mating portion 132 (see FIG. 9) of clapper framework 94 to retain member 94 in the position shown in FIG. 10 against the force of the torsion spring 100 with the delayed start indicator apparatus 24 in its "set" position prior to the start of a race. The clapper mechanism is essentially similar to a mousetrap mechanism which is set in the following manner. With the knob 70 in a position illustrated in FIG. 6 the clapper framework 94 is in the position shown. As the knob 70 is rotated to its raised position an outwardly extending projection 140 (see FIG. 8) is abutting against the upper surface of clapper framework 94 to thereby rotate clapper framework 94 against the force of its bias provided by the coil spring 100 until the detented end of latch arm 128 rests within the mating projection 132 of clapper framework 94 (see FIG. 9) thereby latching the clapper mechanism in the position illustrated in FIG. 10 with a knob 70 and handle 66 being in the position indicated in solid lines. At this point, if the knob 70 is moved rearwardly to the position 70*a* indicated in dotted lines the center of gravity of knob 70 will be rearward of the center of shaft 92 about which it rotates and the clapper mechanism will still be retained in the position shown in FIG. 10 notwithstanding this movement. As the knob 70 rotates downwardly under the force of gravity to the position indicated in dotted lines and designated 70*b* the projection 140 extending outwardly from the periphery of the enlarged circular portion 68 of handle 66 will rotate in a clockwise direction until it abuts against the lower edge of trip arm 130 thereby rotating trip arm member 126 in a clockwise direction to thereby release latch arm 128 from the mating portion 132 of clapper framework 94 thereby suddenly releasing the clapper mechanism to permit clapper framework 94 to rotate in a clockwise direction under the force of torsion spring 100 with clapper 112 suitably bending at portions 118 and 120 until the disc portion 116 thereof strikes the speaker member 90 thereby emitting an audible sound shortly after the knob 70 reaches its lower position as indicated in FIG. 6.

In order to provide a predetermined time duration of travel of the knob 70 from the dotted line position indicated at 70*a* in FIG. 10 to the dotted line position or lower position designated 70*b* the knob 70 is positionable lengthwise of the handle 66 to thereby vary the distance of the center of gravity of knob 70 from its pivot shaft 92. The upper end of handle 66 has a generally circular cross section portion 146 having outwardly extending tangs adapted to frictionally engage an inner circular serrated surface 148 formed integrally within knob 70. In this manner the knob 70 can be moved outwardly from shaft 92, for example, to the position shown in dotted lines and designated as 70*c*, thereby increasing the lever arm resulting in a decreased predetermined time duration for travel of the knob 70 from the position designated 70*a* to the lower position shown in dotted lines and designated 70*b*.

As shown in FIG. 8 the enlarged circular portion 68 of handle 66 has an inner circular recess 150 configured to matingly received a clutch disc 152 which is retained within recess 150 by means of tabs 154 positioned about the periphery of recess 150. The clutch disc 152 is made of an acetal copolymer material which is a somewhat self-lubricating plastic material. A viscous material is placed between the mating surfaces of clutch disc 152 and circular portion 68 within recess 150 to allow a slow, gradual downward movement of knob 70 with no friction from shaft 92. The aperture 156 centrally located within clutch disc 152 loosely engages shaft 92 although clutch disc 152 is secured within the housing 58 to prevent rotation thereof. The centrally disposed aperture 158 within the enlarged circular portion 68 of handle 66 is somewhat larger in diameter to permit pivotal movement of handle 66 with respect to clutch disc 152, essentially providing a friction clutch means to permit the knob 70 and the handle 66 to pivot under the force of gravity suitably controlled by the viscous fluid to provide a reasonable predetermined time duration of travel under the force of gravity with a slow, gradual descent. Without the friction clutch arrangement or a suitable alternative the handle would drop rather rapidly thereby limiting the amusement value of the toy. The outer surface of clutch disc 152 is provided with a protuberance 160 which is generally U-shaped in cross section and as shown in FIG. 7 is adapted to have a downwardly depending projection 162 extending therein to retain clutch disc 152 in a stationary position during rotation of the handle 66, the protuberance 160 being displaced along the radius of clutch disc 152 so as to permit tabs 154 to pass thereby. The downwardly depending projection 162 is formed integrally with the undersurface of housing 58.

Referring now to FIG. 12 the flag and trigger mechanism can be seen to include a trigger lever member 164 and a flag lever member 110, the trigger lever member 164 including the trigger 72 and the flag lever member 110 including the flag 80 previously discussed. The trigger lever member 164 includes a main shaft 168 having formed integral therewith the trigger 72 which is positioned generally centrally of shaft 168, the trigger 72 being configured with an offset to permit the pivoting of shaft 168 below the surface of pathway 62 with trigger 72 extending upright from slot 70 when in its set position. At one end of shaft 168 and formed integrally therewith is the reset arm 74 while the other end of shaft 168 has integral therewith a catch arm 170 which is shown as being upwardly diverging from a plane extending through trigger 72. The free end of catch arm 170 is adapted to engage a latch portion 172 of flag lever member 110, the latch portion 172 extending from a pivot shaft portion 174 in a direction generally opposite to the direction of the plane of flag 80. The flag lever member 110 is a single molded plastic part which includes the shaft 174, the flag 80 and the latch portion 172. The shaft 174 is suitably pivotally secured to the undersurface of housing 58 as illustrated in FIGS. 6 and 10. One end of the shaft 174 is provided with an enlarged bulk portion to provide a counterbalance 176. The interconnecting portion 178 between counterbalance 176 and shaft 174 is provided with an outwardly extending pin 108 previously discussed in conjunction with FIG. 6.

The trigger member 168 and flag lever member 110 are releasably engaged and are essentially as typified by the positions of the parts shown in the pathway 62 of FIG. 5, that is, with the trigger 72 and the flag 80 in position for the start of a race. It is to be understood that although the pivoting means are not shown in FIG. 12 the shaft 168 is suitably secure for pivoting on the undersurface of housing 58. As a vehicle travels pathway 62 and engages trigger 72, trigger 72 is forced downwardly into slot 70 of pathway 62 thereby rotating trigger lever member 164 in a counterclockwise direction as viewed in FIG. 12 and FIG. 10 which likewise depicts the flag lever member 110 and trigger lever member 164 in their "pre-race" positions. As trigger lever member 164 rotates counterclockwise catch arm 170 thereof is released from latch portion 172 of flag lever member 110. At this point with no intervention of the inhibitor arm 106 carried by clapper framework 94, the counterbalance 176, under the force of gravity, will start to drop thereby rotating flag member 166 in a clockwise direction until flag 80 is in an upright position (as shown in FIG. 7 and FIG. 5 in conjunction with pathway 60). Conversely, if the inhibitor arm 106 is in the position shown in FIG. 6 prior to the engagement of a vehicle with trigger 72, the inhibitor arm 106 will engage projection adjacent counterbalance 176 thereby preventing rotation of flag lever member 166, thereby retaining the flag 80 in its lower position flush with the adjacent surface of housing 58. This sequence will only occur if knob 70 is in its lower position as shown in FIG. 6.

The operation of the apparatus will now be described. The speaker member 90 is a generally cup-shaped plastic member with the grillwork 88, in the preferred illustration, being an open grillwork. In order to provide additional amusement value, if a child so desires, a talcum powder can be inserted into the speaker member 90 through the grillwork 88 before operation of the apparatus. In this manner when the clapper 112 has the enlarged disc 116 thereof striking the bottom of speaker member 90, in addition to providing an audible signal a puff of "smoke" can be simulated to indicate the start of the race. Initially, the child sets up the track system shown in FIG. 1 and then raises the knob 70 to rotate the handle 66 upwardly until the knob 70 is in the solid line position indicated in FIG. 10. The child can then of course suitably adjust the position of the knob between the solid line position or the dotted line position designated **70*c*, to make the delayed start time duration varied according to his own desires. At this point the clapper mechanism will be in the position shown in FIG. 10. The race participants then reset the flag and trigger mechanism, if required, by rotating the trigger reset arms 74 and 82 to the rearward position will then releasibly latch the flag lever member 110 in the position shown in FIG. 12 with the trigger lever member 164 having the trigger reset arm 74 pulled to its rearward position. This is referred to as the race ready position which is likewise illustrated in solid lines in FIG. 10. The race participants then pull back the pusher arms 40 to their fully retracted position shown in solid lines in FIG. 4 (or some intermediate position desired) until the downwardly depending bar 48 is suitably detented within one of the detents 42*a*–42*d* of the latching mechanism 42. The toy vehicle launcher at this point is pre-loaded with the pusher arm 40 set against the force of the elastic band 52. The toy vehicles 30 and 32 are then positioned on the pathway 38 of the toy vehicle launchers 20 and 22, respectively, with the bumpers of the vehicles abutting against the resilient portion 56 of pusher arm 40**. At this point the race is ready to commence.

One of the participants then rotates the knob 70 along with its handle 66 to the position indicated in the dotted lines and designated at **70*a* in FIG. 10 at which point the center of gravity of the knob 70 is to the right, or rearward, of the shaft 92 about which the handle 66 rotates. The knob 70 then commences moving under the force of gravity suitably dampened in its movement by the friction clutch means which includes clutch 152 coating with the lubricated recess 150 of the enlarged circular portion 68 of the handle 66. At all positions of travel of knob 70 between the dotted line designated 70*a* and just prior to the dotted line position designated 70*b* the clapper mechanism remains in the position shown in FIG. 10 and similarly the trigger lever member 164 and flag lever member 110 will remain in the position shown in FIG. 10 (as well as FIG. 12) until either trigger 72 is engaged by a vehicle traversing the pathway 60 or 62. If either vehicle starts prematurely by the operator depressing the button 44 in advance of the knob reaching the dotted line position designated 70*b*, the trigger 72 will be actuated thereby permitting counterbalance 176 to rotate flag lever member 166 thereby raising the false start or "foul" flag 80** to thereby provide a visual indication of a premature start on the part of one of the participants.

If no premature start situation exists the knob will commence to its lower position designated in dotted lines as **70*b* in FIG. 10 at which point the projection 140 carried by the enlarged circular portion 68 of handle 66 will contact and move the trip arm 130 thereby pivoting trip arm member 126 to permit latch arm 128 to release the clapper framework 94 which rotates clockwise under the force of the torsion spring 100 with clapper 112 having the disc portion 116 thereof banging against speaker member 80 thereby emitting an audible sound as well as a puff of smoke, if talcum powder is used, to indicate the start of a race. If the vehicles are then released by depression of start button 44 the pusher arm 40 (see FIG. 4) moves under the force of the elastic band 52 to launch the toy vehicles 30 and 32 respectively along the pathways through pathways 60 and 62 along tracks 26 and 28 respectively to the finish gate (shown in dotted lines in FIG. 2). As this occurs the vehicles will naturally contact the triggers 72 and 84 thereby rotating trigger lever member 164 in a counterclockwise direction as viewed in FIGS. 10 and 12. However, as shown in FIG. 6, the inhibitor arm 106 coacts with pin 108 of flag member 110 to prevent rotation thereof with the result being that the flag lever member 110 is retained in position shown in solid lines in FIG. 6 with trigger lever member 164 rotated to the position shown in solid lines. Consequently, flag 80 will not be raised thereby indicating a proper start of the participants in this race. The dotted line position of flag lever member 166 shown in FIG. 6** illustrates the premature start position previously discussed.

While there has been shown and discussed a preferred embodiment, it is to be understood that various other adaptations and modificatins may be made within the spirit and scope of the invention.

What is claimed is:

1. In a delayed action starting apparatus for use with toy racing cars or the like, the combination comprising:

a housing;

timer means coupled to said housing and operable under the force of gravity between upper and lower positions;

a spring-biased mechanism pivotally mounted within said housing;

latch means;

means on said timer means adapted to pivot said spring-biased mechanism against the force of its bias to engage said latch means upon movement of said timer means from said lower to said upper position, said means on said timer means being adapted to disengage said latch means upon said timer means reaching said lower position; and other means mounted within said housing for emitting an audible signal in response to the pivoting of said mechanism under the force of its bias spring when released.

2. The combination according to claim 1 wherein said timer means includes a handle and knob assembly pivotally mounted in said housing, said handle and knob assembly being manually operable to its upper position to reactivate said timer means.

3. The combination according to claim 2 wherein said other means is a speaker member and said spring-biased mechanism includes a clapper adapted to strike said speaker member.

4. The combination according to claim 3 wherein said spring-biased mechanism includes a frame portion secured for pivoting about the shaft of said handle and knob assembly.

5. The combination according to claim 4 wherein said means on said timer means is a projection on said handle adapted to engage said frame.

6. The combination according to claim 5 wherein said latch means is a pivotally mounted member having a latch arm and a release arm, the latch arm being adapted to engage said frame against the force of the bias spring and said release arm being adapted to be engaged by said projection on said handle whereby to disengage said latch arm.

7. The combination according to claim 6 wherein said clapper is a unitary member having one end thereof secured to said frame and having an enlarged clapper portion at the other end thereof.

8. The combination according to claim 7 wherein the spring-bias is provided by a coil spring encircling said shaft and having one end coacting with the housing and the other end thereof coacting with said frame.

* * * * *